US010330068B2

(12) United States Patent
Denk et al.

(10) Patent No.: US 10,330,068 B2
(45) Date of Patent: Jun. 25, 2019

(54) DETERMINING THE MOVEMENT BEHAVIOR OVER TIME OF A FUEL INJECTOR ON THE BASIS OF AN EVALUATION OF THE CHRONOLOGICAL PROGRESSION OF VARIOUS ELECTRICAL MEASUREMENT VARIABLES

(71) Applicant: Continental Automotive GmbH, Hannover (DE)

(72) Inventors: Frank Denk, Obertraubling (DE); Gerd Roesel, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 417 days.

(21) Appl. No.: 14/384,013

(22) PCT Filed: Mar. 27, 2013

(86) PCT No.: PCT/EP2013/056618
§ 371 (c)(1),
(2) Date: Sep. 9, 2014

(87) PCT Pub. No.: WO2013/149924
PCT Pub. Date: Oct. 10, 2013

(65) Prior Publication Data

US 2015/0152830 A1 Jun. 4, 2015

(30) Foreign Application Priority Data

Apr. 4, 2012 (DE) ..... 10 2012 205 573

(51) Int. Cl.
*F02D 41/20* (2006.01)
*F02D 41/04* (2006.01)
(Continued)

(52) U.S. Cl.
CPC ..... *F02M 65/00* (2013.01); *F02D 41/04* (2013.01); *F02D 41/14* (2013.01); *F02D 41/20* (2013.01);
(Continued)

(58) Field of Classification Search
CPC ..... F02D 41/20; F02D 2041/2055; F02D 2041/2031
See application file for complete search history.

(56) References Cited

U.S. PATENT DOCUMENTS 4,140,084 A 2/1979 Di Nunzio ..... 123/490
5,182,517 A 1/1993 Thelen et al. ..... 324/418
(Continued)

FOREIGN PATENT DOCUMENTS

CN 102251866 A 11/2011 ..... F02D 41/30
CN 102272435 A 12/2011 ..... F02D 41/20
(Continued)

OTHER PUBLICATIONS

Chinese Office Action, Application No. 201380018382.4, 16 pages, dated Mar. 18, 2016.
(Continued)

*Primary Examiner* — Son T Le
*Assistant Examiner* — Herbert K Roberts
(74) *Attorney, Agent, or Firm* — Slayden Grubert Beard PLLC

(57) ABSTRACT

A method for determining the movement behavior of a fuel injector having a coil drive includes: (a) applying an electrical excitation to a coil of the coil drive, which prompts an opening movement of a valve needle; (b) recording the temporal progression of a first electrical measurement variable of the coil; (c) determining the time when the opening movement ends based on the recorded temporal progression of the first electrical measurement variable; (d) modifying
(Continued)

the electrical excitation of the coil such that the valve needle performs a closing movement; (e) recording the temporal progression of a second electrical measurement variable of the coil; and (f) determining the time when the closing movement ends based on the recorded temporal progression of the second electrical measurement variable. One of the two measurement variables is the voltage present at the coil and the other is the intensity of current flowing through the coil.

17 Claims, 1 Drawing Sheet

(51) Int. Cl.
*F02D 41/14* (2006.01)
*F02M 65/00* (2006.01)
*F02D 41/24* (2006.01)

(52) U.S. Cl.
CPC .. *F02D 41/2467* (2013.01); *F02D 2041/2051* (2013.01); *F02D 2041/2055* (2013.01); *F02D 2041/2058* (2013.01)

(56) References Cited

U.S. PATENT DOCUMENTS

| | | | | |
|---|---|---|---|---|
| 5,245,501 | A | 9/1993 | Locher et al. | 361/154 |
| 6,192,856 | B1 * | 2/2001 | Shioi | F02D 41/20 123/300 |
| 2011/0273812 | A1 | 11/2011 | Beer et al. | 361/152 |
| 2011/0278369 | A1 | 11/2011 | Serra et al. | 239/5 |
| 2013/0073188 | A1 | 3/2013 | Rösel | 701/105 |

FOREIGN PATENT DOCUMENTS

| | | | | |
|---|---|---|---|---|
| DE | 2655615 | A1 | 6/1977 | F02D 41/20 |
| DE | 3843138 | A1 | 6/1990 | B60T 8/36 |
| DE | 3942836 | C2 | 6/1992 | F02D 41/20 |
| DE | 10129153 | A1 | 1/2003 | H01F 7/18 |
| DE | 102010000872 | A1 * | 3/2011 | F02D 41/20 |
| DE | 102010022109 | B3 | 9/2011 | F02D 41/20 |
| WO | 94/13991 | A1 | 6/1994 | F02D 41/20 |
| WO | 2013/149924 | A1 | 10/2013 | F02D 41/14 |

OTHER PUBLICATIONS

International Search Report and Written Opinion, Application No. PCT/EP2013/056618, 11 pages, dated Jul. 4, 2013.

* cited by examiner

DETERMINING THE MOVEMENT BEHAVIOR OVER TIME OF A FUEL INJECTOR ON THE BASIS OF AN EVALUATION OF THE CHRONOLOGICAL PROGRESSION OF VARIOUS ELECTRICAL MEASUREMENT VARIABLES

CROSS-REFERENCE TO RELATED APPLICATIONS

This application is a U.S. National Stage Application of International Application No. PCT/EP2013/056618 filed Mar. 27, 2013, which designates the United States of America, and claims priority to DE Application No. 10 2012 205 573.8 filed Apr. 4, 2012, the contents of which are hereby incorporated by reference in their entirety.

TECHNICAL FIELD

The present invention relates to the technical field of the activation of fuel injectors, which have a magnetic armature, which is mechanically coupled to a valve needle, and a coil drive having a coil for moving the magnetic armature. The present invention relates in particular to a method and a device, an engine controller, and a computer program for determining the movement behavior over time of a fuel injector having a coil drive or an internal combustion engine of a motor vehicle, wherein the determination of the movement behavior is performed on the basis of an evaluation of the chronological progression of an electrical measurement variable of a coil of the coil drive. Furthermore, the present invention relates to a method for activating a fuel injector having a coil drive for an internal combustion engine of a motor vehicle on the basis of a movement behavior over time determined using the above-mentioned method.

BACKGROUND

During the operation of direct drive fuel injectors in particular, which have a magnetic armature, which is mechanically coupled to a valve needle, and a coil drive having a coil for moving the magnetic armature, with identical current/voltage parameters, because of electrical, magnetic, and/or mechanical tolerances, differing opening and/or closing behavior over time of the individual fuel injectors occurs. This in turn results in undesired injector-individual variations in the quantity of the actually injected fuel.

The relative injection quantity differences from fuel injector to fuel injector are increased, however, as injection times become shorter and therefore injection quantities become smaller. It is already important for modern engines, and in consideration of a further reduction of pollutant emissions it will become still more important for future engine generations, that a high quantity precision can also be ensured in the case of small fuel quantities to be injected. A high quantity precision can only be achieved, however, if the actual movement behavior of the valve needle or of the magnetic armature is known in particular during the opening operation and/or during the closing operation.

The coil current required for operating a fuel injector having a coil drive is typically provided by suitable current regulator hardware. The resulting chronological progression of the current through the coil of the coil drive is dependent in this case, inter alia, on the inductance and the electrical resistance of the coil. The electrical resistance is composed of the ohmic resistance of the turn(s) of the coil and the resistance of the (ferro-)magnetic material of the fuel injector. Eddy currents, which flow in the ferromagnetic material because of magnetic flux changes, are damped by the finite electrical resistance of the (ferro-)magnetic material.

The end of an opening movement of the magnetic armature or the valve needle (the magnetic armature stops on a mechanical opening stop) and also the end of the following closing movement of the magnetic armature or the valve needle (the magnetic armature stops on a valve seat) can be determined by means of a precise evaluation of the exact chronological progression of the coil current or the coil voltage. Specifically, these ends are each recognizable as a bend in the progression of the coil current or the coil voltage.

SUMMARY

One embodiment provides a method for determining the movement behavior over time of a fuel injector having a coil drive for an internal combustion engine of a motor vehicle, the method including applying an electrical excitation to a coil of the coil drive, which results in an opening movement of a valve needle, which is coupled to a magnetic armature of the coil drive, recording the chronological progression of a first electrical measurement variable of the coil, determining the time when the opening movement ends on the basis of the recorded chronological progression of the first electrical measurement variable, modifying the electrical excitation of the coil so that the valve needle executes a closing movement, recording the chronological progression of a second electrical measurement variable of the coil, and determining the time when the closing movement ends on the basis of the recorded chronological progression of the second electrical measurement variable, wherein one of the two measurement variables is the level of the voltage which is applied to the coil and the other of the two measurement variables is the strength of the current which flows through the coil.

In a further embodiment, the first electrical measurement variable is the strength of the current which flows through the coil, and wherein the second electrical measurement variable is the level of the voltage which is applied to the coil.

In a further embodiment, a first measurement signal assigned to the first electrical measurement variable is conditioned by means of a first electronic circuit and in which a second measurement signal assigned to the second electrical measurement variable is conditioned by means of a second electronic circuit, wherein the first electronic circuit is different from the second electronic circuit.

In a further embodiment, the method further includes ascertaining a first time delay in the signal conditioning of the first measurement signal, and ascertaining a second time delay in the signal conditioning of the second measurement signal, wherein the determination of the time when the opening movement ends is furthermore performed on the basis of the first time delay, and wherein the determination of the time when the closing movement ends is furthermore performed on the basis of the second time delay.

In a further embodiment, the ascertainment of the first time delay includes feeding a first test signal into the first electronic circuit, wherein the first test signal has an at least approximately sudden first level change, and evaluating the chronological progression of a first output signal of the first electronic circuit, wherein the first output signal is the response of the first electronic circuit to the first test signal, and/or wherein the ascertainment of the second time delay includes feeding a second test signal into the second electronic circuit, wherein the second test signal has an at least approximately sudden second level change, and evaluating the chronological progression of a second output signal of the second electronic circuit, wherein the second output signal is the response of the second electronic circuit to the second test signal.

In a further embodiment, the first test signal and/or the second test signal are component of an electrical excitation, which is applied to the coil drive of the fuel injector in real operation of the internal combustion engine.

In a further embodiment, the first test signal has a further first level change, which is opposite to the first level change and/or wherein the second test signal has a further second level change, which is opposite to the second level change.

Another embodiment provides a method for activating a fuel injector having a coil drive for an internal combustion engine of a motor vehicle, the method including determining the movement behavior over time of the fuel injector by means of a method as disclosed above, and adapting the electrical activation of the fuel injector on the basis of the determined movement behavior over time, so that a predetermined quantity of fuel is injected using an injection operation.

Another embodiment provides a device for determining the movement behavior over time of a fuel injector having a coil drive for an internal combustion engine of a motor vehicle, the device including an electrical regulating unit configured to apply an electrical excitation to a coil of the coil drive, which results in an opening movement of a valve needle, which is coupled to a magnetic armature of the coil drive, a measuring unit configured to record the chronological progression of a first electrical measurement variable of the coil, and a data processing unit configured to determine the time when the opening movement ends on the basis of the recorded chronological progression of the first electrical measurement variable, wherein the electrical regulating unit is furthermore configured to modify the electrical excitation of the coil so that the valve needle executes a closing movement, wherein the measuring unit is furthermore configured to record the chronological progression of a second electrical measurement variable of the coil, wherein the data processing unit is furthermore configured to determine the time when the closing movement ends on the basis of the recorded chronological progression of the second electrical measurement variable, and wherein one of the two measurement variables is the level of the voltage which is applied to the coil, and the other of the two measurement variables is the strength of the current which flows through the coil.

Another embodiment provides an engine controller for an internal combustion engine of a motor vehicle, the engine controller having a device as disclosed above for determining the movement behavior over time of a fuel injector having a coil drive for the internal combustion engine.

Another embodiment provides a computer program for determining the movement behavior over time of a fuel injector having a coil drive for an internal combustion engine of a motor vehicle, wherein the computer program, when it is executed by a processor, is configured to perform any of the methods disclosed above.

BRIEF DESCRIPTION OF THE DRAWINGS

Example embodiments of the invention are discussed below in more detail with reference to the drawings, in which.

Figure 1:
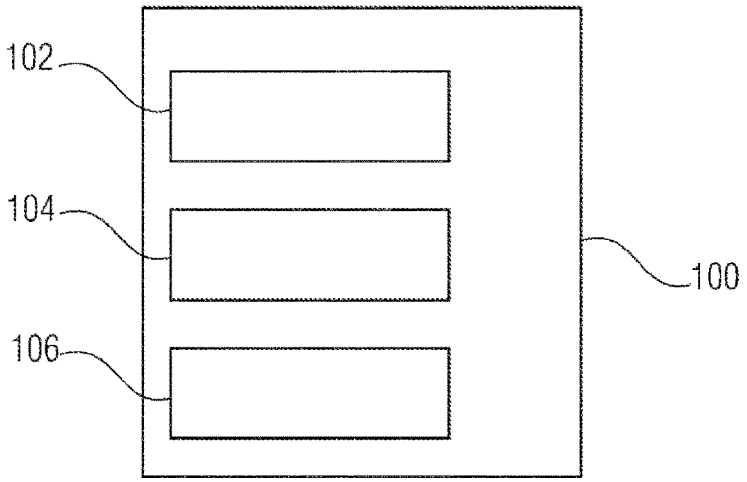
FIG. 1 shows a device for determining the movement behavior over time of a fuel injector.

It is to be noted that the embodiments described hereafter only represent a restricted selection of possible embodiment variants of the invention. In particular, it is possible to combine the features of individual embodiments with one another in a suitable manner, so that for a person skilled in the art, a plurality of different embodiments can be considered to be obviously disclosed with the embodiment variants explicitly shown here.

DETAILED DESCRIPTION

Embodiments of the present invention are capable of characterizing the actual movement behavior of a fuel injector as much as possible without additional apparatus expenditure.

According to a first aspect of the invention, a method for determining the movement behavior over time of a fuel injector having a coil drive for an internal combustion engine of a motor vehicle is described. The described method has (a) applying an electrical excitation to a coil of the coil drive, which results in an opening movement of a valve needle, which is coupled to a magnetic armature of the coil drive; (b) recording the chronological progression of a first electrical measurement variable of the coil; (c) determining the time when the opening movement ends on the basis of the recorded chronological progression of the first electrical measurement variable; (d) modifying the electrical excitation of the coil so that the valve needle executes a closing movement; (e) recording the chronological progression of a second electrical measurement variable of the coil; and (f) determining the time when the closing movement ends on the basis of the recorded chronological progression of the second electrical measurement variable. According to the invention, one of the two measurement variables is the level of the voltage which is applied to the coil, and the other of the two measurement variables is the strength of the current which flows through the coil.

The described method is based on the finding that by way of the evaluation of two different electrical measurement variables, the times when (a) the opening movement ends and (b) the closing movement ends can be determined particularly precisely and therefore important findings can be obtained about the actual movement behavior of the fuel injector. This in turn enables particularly precise fuel metering for the combustion operations in an internal combustion engine of a motor vehicle.

The described electrical excitation can be any desired chronological progression of current and/or voltage, which ensures that a valve needle of the fuel injector is temporarily deflected from its closed position and therefore enables an injection operation of the fuel injector. The electrical excitation can have a chronological progression depending on the special application, which has in a known manner, for example, a precharge phase, a boost phase, a decommutation phase, and/or a holding phase.

The electrical measurement variables, which are firstly recorded as analog measurement variables, can be further processed in analog and/or digital form. The respective signal processing can comprise, in a known manner, suitable signal conditioning, for example, amplification, filtering (for example, to remove undesired high-frequency noise), and/or impedance adaptation. A conversion of an analog signal into a corresponding digital signal can be performed by means of an analog digital converter and in particular using a so-called fast analog digital converter (FADC).

According to one exemplary embodiment of the invention, the first electrical measurement variable is the strength of the current which flows through the coil, and the second electrical measurement variable is the level of the voltage which is applied to the coil. This has the advantage that particularly high precision can be achieved both in determining when the opening movement ends and also in determining when the closing movement ends. The inventors of the method described in this document have specifically recognized that (a) the progression of the opening movement can be determined particularly precisely by means of a suitable current measurement method and (b) the progression of the closing movement can be determined particularly precisely by means of a suitable voltage measurement method.

The measurement of the current strength can be performed by means of a suitable current measurement method, in which, for example, the current value is recorded via an FADC in a digital manner and the time when the opening movement ends is detected in relation to the beginning of the energizing. To record the current strength, the voltage drop at a shunt (measurement resistor) can be measured. The shunt can be located according to the concept in a current path to ground.

The measurement of the level of the voltage applied to the coil drive can be performed by means of a suitable voltage measurement method, in which the corresponding voltage values are recorded, for example, via a second FADC in a digital manner and the end of the closing movement is detected in relation to the end of the energizing. In this case, the voltage applied to the coil drive can be recorded directly, the use of a shunt is not necessary.

According to a further exemplary embodiment of the invention (a) a first measurement signal assigned to the first electrical measurement variable is conditioned by means of a first electronic circuit and (b) a second measurement signal assigned to the second electrical measurement variable is conditioned by means of a second electronic circuit. In this case, the first electronic circuit is different from the second electronic circuit. This has the advantage that for different measurement principles, a current measurement and a voltage measurement, an optimally suitable electronic circuit can be used in each case. Therefore, both measurement channels, the current measurement channel and the voltage measurement channel, each have the electronic components suitable for optimum signal conditioning.

Expressed descriptively, this means that the various measurement channels represent an adaptation of the signal to be measured to the input of a corresponding FADC. This applies in particular with respect to the value range of the corresponding measurement signal, with respect to the signal resolution, and with respect to the signal impedance.

The first and the second electronic circuits are different circuits. This means that at least some of the components of the first electronic circuit are not used for the signal conditioning by means of the second electronic circuit. The same also applies in reverse for at least some of the components of the second electronic circuit. However, the two electronic circuits are preferably completely separated from one another. This means that no component of the first electronic circuit is also assigned to the second electronic circuit and, vice versa, no component of the second electronic circuit is also assigned to the first electronic circuit.

According to a further exemplary embodiment of the invention, the method furthermore has (a) an ascertainment of a first time delay in the signal conditioning of the first measurement signal, and (b) an ascertainment of a second time delay in the signal conditioning of the second measurement signal. In this case, the determination of the time when the opening movement ends is furthermore performed on the basis of the first time delay and the determination of the time when the closing movement ends is furthermore performed on the basis of the second time delay. This has the advantage that a different time delay due to the two electronic circuits can be determined individually for each circuit and can be taken into consideration when determining the time when the respective movement ends. The precision of the determination of the time when the opening movement ends and the determination of the time when the closing movement ends are thus further improved.

The possibility of considering the individual delay of a specific electronic circuit is of great significance for the following reasons for the precision when determining the movement behavior over time: each electronic circuit has tolerances in manufacturing due to the use of individual electronic components. Because of these tolerances, the time constant per channel also varies. In the present case, the variation of the time constant of the first electronic circuit is independent of the variation of the time constant of the second electronic circuit. However, the corresponding deviations are undesirable, since if a compensation is absent, they result in a generally noticeable inaccuracy in the determined times. Using the circuit-individual compensation described here of these time delays, therefore manufacturing-related tolerances of the electronic circuits for signal conditioning can be recognized and these can be compensated for by a suitably modified activation of the fuel injector.

The first time delay is caused by the first electronic circuit and the second time delay is caused by the second electronic circuit. This can be understood descriptively in a simple manner, because both electronic circuits in idealized form have low-pass filter behavior at least for high (noise) frequencies. This behavior is reflected in a specific time constant T, which the respective electronic circuit displays at the output in relation to a sudden input signal change.

According to a further exemplary embodiment of the invention, the ascertainment of the first time delay has (a) a feed of a first test signal into the first electronic circuit, wherein the first test signal has an at least approximately sudden first level change, and (b) an evaluation of the chronological progression of a first output signal of the first electronic circuit, wherein the first output signal is the response of the first electronic circuit to the first test signal. Alternatively or in combination, the ascertainment of the second time delay has (a) a feed of a second test signal into the second electronic circuit, wherein the second test signal has an at least approximately sudden second level change, and (b) an evaluation of the chronological progression of a second output signal of the second electronic circuit, wherein the second output signal is the response of the second electronic circuit to the second test signal.

The use of test input signals, which have a chronological progression having a sudden level change, has the advantage that the individual time delay which is caused by the respective electronic circuit can be determined in a simple manner. For this purpose, it is specifically only necessary to ascertain the time span which the respective output signal requires to complete its response level change as a response to the sudden level change.

According to a further exemplary embodiment of the invention, the first test signal and/or the second test signal is/are component(s) of an electrical excitation, which is applied to the coil drive of the fuel injector in real operation of the internal combustion engine. This has the advantage that a determination of the individual time delays caused by the two electronic circuits can be carried out in standard operation of the relevant fuel injector. Therefore, in each case the precise time delays can also be determined during the operation of the internal combustion engine in dependence on the current operating conditions. This means that also in the case of varying time delays, which can be caused by changed operating conditions, for example, the temperature, the currently valid time delays can always be used, to determine the times precisely at which the opening movement or the closing movement of the valve needle ends.

In this context, it is to be noted that in known current regulator units (frequently also referred to as current regulator hardware by technicians), which are used to apply electrical excitations suitable for real injection operations to the coil drive, there are short time spans or times in which or at which both the measured current and also the measured voltage suddenly change. These short time spans or times are in particular in a time window which begins immediately after the end of the energizing phase. Specifically, as soon as the electronic switches of the current regulator hardware have reached the state "high resistance", a counter induction is generated on the coil drive, which determines the time at which the voltage applied to the coil of the coil drive suddenly changes. This counter induction is limited in conventional current regulator hardware in that the corresponding energy is fed back into a boost circuit located in the relevant current regulator hardware. Voltage limiting to a voltage −V_boost thus results, which corresponds to approximately the inverted boost voltage. The current arising due to the induction goes to ground (GND) toward 0 A after the feedback via a shunt of the current regulator hardware. This then represents the detectable jump in the current progression.

According to a further exemplary embodiment of the invention, the first test signal has a further first level change, which is opposite to the first level change. Alternatively or in combination, the second test signal has a further second level change, which is opposite to the second level change. This has the advantage that the time delay which is caused by the respective electrical circuit can be determined still more precisely.

Expressed descriptively, this means that the method described in this document can be expanded by an adapted current/voltage activation, so that a second flank additionally appears at the input of the current or voltage measurement, the sign of which is inverted in comparison to the sign of the first flank (i.e., the above-mentioned sudden first or second level change, respectively) and which (the second flank) can be generated at a defined time interval in comparison to the first flank.

According to a further aspect of the invention, a method for activating a fuel injector having a coil drive for an internal combustion engine of a motor vehicle is described. The described activation method has (a) a determination of the movement behavior over time of the fuel injector by means of an above-mentioned method for determining the movement behavior over time of a fuel injector having a coil drive and (b) an adaptation of the electrical activation of the fuel injector on the basis of the determined movement behavior over time, so that a predetermined quantity of fuel is injected using an injection operation.

The described activation method is based on the finding that the above-explained method for determining the movement behavior over time of a fuel injector having a coil drive can be used for the purpose of adapting the electrical activation of the fuel injector on the basis of precise knowledge (a) of the time when the opening movement of the valve needle ends and (b) of the time when the closing movement of the valve needle ends such that the duration within which the fuel injector is actually open is adapted with regard to an optimum fuel injection quantity, so that this corresponds as precisely as possible to a target quantity predefined for a specific operating state.

Using the described activation method, the quantity precision of the fuel injector can be substantially improved in particular in the case of small quantities and therefore an important contribution can be made for lower fuel consumption and/or for reduced pollutant emissions.

Expressed descriptively, by way of a suitable mathematical method, for example, analog sampling and/or a comparison to a target value, the deviation of the ascertained times, when the opening movement or the closing movement ends, respectively, from this target value can be ascertained. This target value can represent in particular a standard value for an electronic circuit without tolerances in each case. The injection quantity can be set particularly precisely with regard to high quantity precision of the injected fuel by way of precise knowledge of the deviation in the electronic circuit used in each case, which is real and therefore subject to tolerances, by an adaptation of the beginning of the energizing and the duration of the energizing.

For example, if the time when the opening movement ends has been shifted backward with respect to time, this can be corrected by a corresponding shift forward of the current beginning. In a corresponding manner, if the end of the closing movement has been shifted backward with respect to time, the correspondingly lengthened opening time of the fuel injector can be compensated for by a correspondingly shortened energizing duration. Such corrections can advantageously be executed individually by pulse and/or cylinder.

Since the corrections to be applied are furthermore dependent on physical system parameters, for example, the fuel temperature and the time interval to the preceding injection operation, in addition to the tolerances of the fuel injector, these dependencies can be stored in suitable pilot control characteristic curves or pilot control characteristic maps or described by a model.

According to a further aspect of the invention, a device for determining the movement behavior over time of a fuel injector having a coil drive for an internal combustion engine of a motor vehicle is described. The described device has (a) an electrical regulating unit, configured to apply an electrical excitation to a coil of the coil drive, which results in an opening movement of a valve needle, which is coupled to a magnetic armature of the coil drive, (b) a measuring unit, configured to record the chronological progression of a first electrical measurement variable of the coil, and (c) a data processing unit, configured to determine the time when the opening movement ends on the basis of the recorded chronological progression of the first electrical measurement variable. The electrical regulating unit is furthermore configured to modify the electrical excitation of the coil so that the valve needle executes a closing movement. The measuring unit is furthermore configured to record the chronological progression of a second electrical measurement variable of the coil. The data processing unit is furthermore configured to determine the time when the closing movement ends on the basis of the recorded chronological progression of the second electrical measurement variable, wherein one of the two measurement variables is the level of the voltage which is applied to the coil, and the other of the two measurement variables is the strength of the current which flows through the coil.

The described device is also based on the knowledge that by way of the evaluation of two different electrical measurement variables, the times (a) when the opening movement ends and (b) when the closing movement ends can be determined particularly precisely and therefore important findings can be obtained about the actual movement behavior of the fuel injector. This in turn enables more precise fuel metering for the combustion operations in an internal combustion engine of a motor vehicle.

According to a further aspect of the invention, an engine controller for an internal combustion engine of a motor vehicle is described. The described engine controller has (a) an above-described device for determining the movement behavior over time of a fuel injector having a coil drive.

The described engine controller is based on the knowledge that the above-described device can be implemented in an engine controller for an internal combustion engine of a motor vehicle and therefore on the basis of precise knowledge of the actual movement behavior of the valve needle of a fuel injector, by way of a modified electrical injector activation (i) a suitable compensation of injector-individual tolerances and/or (ii) a suitable compensation of individual electrical tolerances of electronic circuits which are used for signal conditioning, for example, can be achieved. Therefore, a particularly high quantity precision for fuel injection operations may be implemented.

According to a further aspect of the invention, a computer program for determining the movement behavior over time of a fuel injector having a coil drive for an internal combustion engine of a motor vehicle is described. The computer program is configured, when it is executed by a processor, to carry out the method for determining the movement behavior over time of a fuel injector having a coil drive.

In the meaning of this document, mentioning such a computer program is equivalent to the concept of a program element, a computer program product, and/or a computer-readable medium which contains instructions for controlling a computer system to coordinate the operating mode of a system or a method in a suitable manner, in order to achieve the effects linked to the method according to the invention.

The computer program can be implemented as a computer-readable instruction code in any suitable programming language, for example, in Java, C++, etc. The computer program can be stored on a computer-readable storage medium (CD-ROM, DVD, Blu-ray disc, removable drive, volatile or nonvolatile memory, installed memory or processor, etc.). The instruction code can program a computer or other programmable devices, such as in particular a control device for an internal combustion engine of a motor vehicle, such that the desired functions are executed. Furthermore, the computer program can be provided in a network, for example, the Internet, from which it can be downloaded as needed by a user.

The invention can be implemented both by means of a computer program, i.e., by means of software, and also by means of one or more special electrical circuits, i.e., in hardware or also in any desired hybrid form, i.e., by means of software components and hardware components.

It is to be noted that embodiments of the invention have been described with reference to different objects of the invention. In particular, several embodiments of the invention have been described with device claims and other embodiments of the invention have been described with method claims. However, it is immediately clear to a person skilled in the art upon reading this application that, if not otherwise explicitly indicated, in addition to a combination of features which are associated with one type of object of the invention, any desired combination of features is also possible, which are associated with different types of objects of the invention.

FIG. 1 shows a device 100 for determining the movement behavior over time of a fuel injector. The device 100 has an electrical regulating unit 102, a measuring unit 104, and a data processing unit 106.

According to the exemplary embodiment shown here, the electrical regulating unit 102 is a current regulating unit, which is configured to apply an electrical excitation to a coil (not shown) of the coil drive in the form of a predefined progression of a current flowing through the coil. The electrical excitation is sufficiently strong in this case that it results in an opening movement of a valve needle, which is coupled to a magnetic armature of the coil drive. The electrical regulating unit 102 is furthermore configured to modify the electrical excitation of the coil so that the valve needle executes a closing movement after the execution of the opening movement. In this case, the closing movement can be caused in particular by the spring force of a spring, which is pre-tensioned by the opening movement.

The measuring unit 104 is configured to record the chronological progression of a first electrical measurement variable of the coil, wherein this first measurement variable is the strength of the current which flows through the coil. The measuring unit 104 is furthermore configured to record the chronological progression of a second electrical measurement variable of the coil, wherein the second measurement variable is the level of the voltage which is applied to the coil.

The measuring unit 104 can be configured such that the mentioned electrical measurement variables are each recorded exclusively in specific time windows, for example, in relation to the beginning or the end of the electrical excitation.

The data processing unit 106 is configured to evaluate the chronological progression of the first electrical measurement variable or the strength of the coil current flowing through the coil and to determine the time when the opening movement ends on the basis of the result of the evaluation of the chronological progression of the first electrical measurement variable. The data processing unit 106 is furthermore configured to evaluate the chronological progression of the second electrical measurement variable or the level of the voltage applied to the coil and to determine the time when the closing movement ends on the basis of the result of the evaluation of the chronological progression of the second electrical measurement variable.

The device 100 or at least parts of the device 100, such as in particular the measuring unit 104 and/or the data processing unit 106, can be implemented in an engine controller for an internal combustion engine of a motor vehicle.

Figure 2:
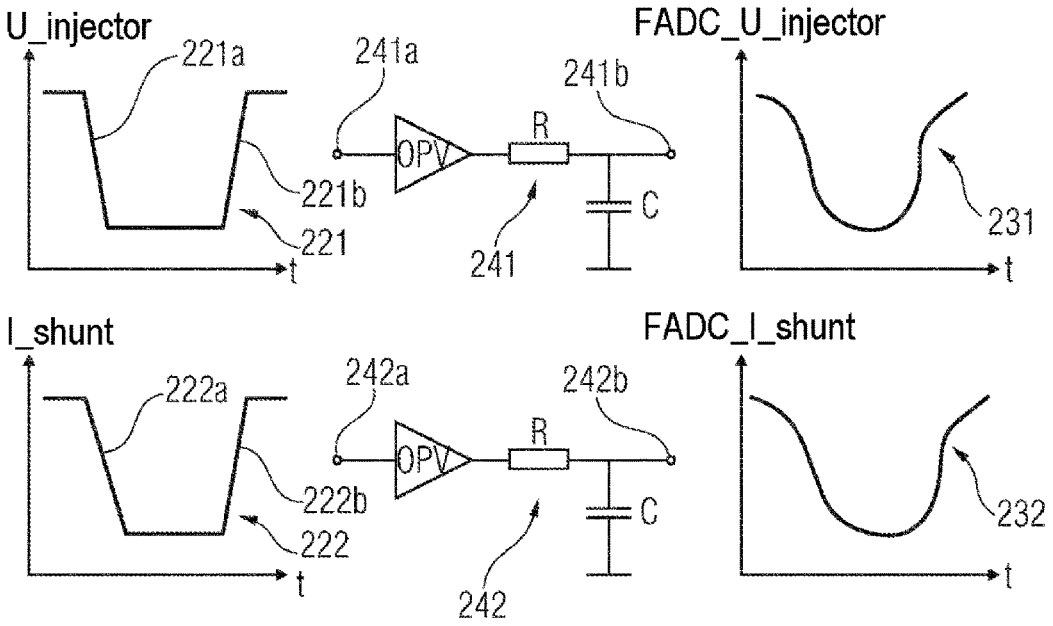
FIG. 2 illustrates an ascertainment of a time delay caused by an electronic signal conditioning circuit on the basis of an evaluation of the chronological progression of an output signal, which is smoothed in comparison to the chronological progression of an input test signal having two flanks.

FIG. 2 illustrates an ascertainment of a time delay caused by an electronic signal conditioning circuit on the basis of an evaluation of the chronological progression of an output signal, which is smoothed in comparison to the chronological progression of an input test signal having two flanks. A first test signal 221 is shown in the top part of FIG. 2, which has two approximately step-shaped level changes in the form of a first flank 221*a* and a second flank 221*b*. According to the exemplary embodiment shown here, this first test signal 221 is the progression of a voltage U_injector, which is applied to the coil of the coil drive of the fuel injector. This voltage progression, which occurs in good approximation also during a conventional activation of a fuel injector, is applied to an input 241*a* of a signal conditioning circuit 241. The signal conditioning circuit 241 is shown in simplified form as a low-pass filter in FIG. 2, which has an operational amplifier OPV, a resistor R, and a capacitor C. At an output 241*b* of the signal conditioning circuit 241, a time-delayed first output signal 231 is then output to a fast analog digital converter (FADC) (not shown), wherein the original flanks 221*a*, 221*b* present in the first test signal 221 are smoothed. The extent of this smoothing, which can be analyzed by an evaluation unit (also not shown) connected downstream from the FADC, is then a measure of the individual time delay which is caused by the signal conditioning circuit 241. In this case, the individual time delay is determined by the individual tolerances for the components which are installed for the signal conditioning circuit 241.

In a corresponding manner, a second test signal 222 having two flanks 222*a* and 222*b* is supplied to an input 242*a* of a second signal conditioning circuit 242. According to the exemplary embodiment shown here, this second test signal 222 is the progression of a current I_shunt, which flows through a shunt connected in series to the coil of the coil drive of the fuel injector and which also occurs in good approximation during a conventional activation of a fuel injector. The second signal conditioning circuit 242 also has the character of a low-pass filter circuit, which is schematically shown in FIG. 2 by means of an operational amplifier OPV, a resistor R, and a capacitor C. A second output signal 232 is also output here at an output 242*b* of the second signal conditioning circuit 242, wherein the flanks 222*a*, 222*b* originally present in the second test signal 222 are smoothed. The extent of this smoothing is supplied after digitization by a further FADC (not shown) to a further evaluation unit (also not shown). This further evaluation unit then analyzes the output signal 232 and determines, on the basis of the performed smoothing, the individual time delay which is caused by the signal conditioning circuit 242. In this case, the individual time delay is determined by the individual tolerances for the components which were installed for the signal conditioning circuit 242.

According to the exemplary embodiment described here, different measurement channels are thus used for the two measurement signals, one of which is the progression of a voltage signal and the other of which is the progression of a current signal, wherein each measurement channel has a signal conditioning circuit 241 or 242 and also an FADC (not shown in each case). The evaluation to be performed by the two FADCs after the digitization can be performed by means of a shared evaluation unit or by means of two different evaluation units.

The individual determination described here of the time delay for each measurement channel has the advantage that a different time delay through the two electronic circuits can be determined individually for each circuit and taken into consideration during the determination of the time when the respective movement ends. Particularly high precision is thus achieved in the determination of the time when the opening movement ends and in the determination of the time when the closing movement ends. Based on such a precise knowledge of the movement behavior of the individual fuel injector and the time delays through the two individual signal conditioning circuits, an electrical activation of the coil drive of the fuel injector can then be adapted so that a particularly high quantity precision of the injected fuel can be achieved.

LIST OF REFERENCE SIGNS

100 device for determining the movement behavior over time of a fuel injector
102 electrical regulating unit/current regulating unit
104 measuring unit
106 data processing unit
221 first test signal
221*a* first flank
221*b* second flank
222 second test signal
222*a* first flank
222*b* second flank
231 first output signal
232 second output signal
241 first electronic circuit/first signal conditioning circuit
241*a* input
241*b* output
242 second electronic circuit/second signal conditioning circuit
242*a* input
242*b* output
U_injector voltage at the injector
FADC_U_injector voltage at the output 241*b* of the first signal conditioning circuit 241
I_shunt current through shunt resistor
FADC_I_shunt voltage at the output 242*b* of the second signal conditioning circuit 242
OPV operational amplifier
R resistor
C capacitor

What is claimed is:

1. A method for determining the movement behavior over time of a fuel injector having a coil drive for an internal combustion engine of a motor vehicle, the method comprising:

determining a first time delay defining individual time required for signal conditioning of a first measured signal caused by characteristics of a first electronic circuit for a first electrical measurement variable, wherein determining the first time delay defining individual time required for signal conditioning of the first measured signal includes determining time required for at least one of amplification of the first measured signal, determining a second time delay defining individual time required for signal conditioning of a second measured signal caused by characteristics of a second electronic circuit for a second electrical measurement variable, applying an electrical excitation to a coil of the coil drive, which results in an opening movement of a valve needle coupled to a magnetic armature of the coil drive, recording a chronological progression of the first electrical measurement variable of the coil in response to the electrical excitation, determining a time when the opening movement ends based on the recorded chronological progression of the first electrical measurement variable, adjusting the determined time of the opening movement ending based upon time individually required for signal conditioning of the first measured signal as defined by the first time delay, modifying the electrical excitation of the coil such that the valve needle executes a closing movement, recording a chronological progression of the second electrical measurement variable of the coil, determining a time when the closing movement ends based on the recorded chronological progression of the second electrical measurement variable in response to the modified electrical excitation, adjusting the time of the closing movement ending based upon time individually required for signal conditioning of the second measured signal as defined by the second time delay, and wherein one of the two measurement variables represents a level of the voltage applied to the coil and the other of the two measurement variables represents a strength of a current that flows through the coil.

2. The method of claim 1, wherein the first electrical measurement variable represents the strength of the current that flows through the coil, and the second electrical measurement variable represents the level of the voltage applied to the coil.

3. The method of claim 1, wherein the first electronic circuit is different from the second electronic circuit.

4. The method of claim 1, wherein the method includes at least one of the following:

(a) the determination of the first time delay includes:

feeding a first test signal into the first electronic circuit, wherein the first test signal has at least an approximate step-shaped change in input, and evaluating a chronological progression of a first output signal of the first electronic circuit, wherein the first output signal is a response of the first electronic circuit to the first test signal, and (b) the determination of the second time delay includes:

feeding a second test signal into the second electronic circuit, wherein the second test signal has at least an approximate step-shaped change in input, and evaluating a chronological progression of a second output signal of the second electronic circuit, wherein the second output signal is a response of the second electronic circuit to the second test signal.

5. The method of claim 4, wherein the first test signal and/or the second test signal are component of an electrical excitation, which is applied to the coil drive of the fuel injector in real operation of the internal combustion engine.

6. The method of claim 4, wherein the method includes at least one of the following:

the first test signal has a further approximate step-shaped change in input, which is opposite to the first approximate step-shaped change in input, and the second test signal has a further approximate step-shaped change in input, which is opposite to the second approximate step-shaped change in input.

7. The method of claim 1, wherein determining the first time delay defining individual time required for signal conditioning of the first measured signal includes determining time individually required for amplification of the first measured signal.

8. The method of claim 1, wherein determining the first time delay defining individual time required for signal conditioning of the first measured signal includes determining time individually required for filtering the first measured signal.

9. The method of claim 1, wherein determining the first time delay defining individual time required for signal conditioning of the first measured signal includes determining time individually required for impedance adaptation of the first measured signal.

10. A method for activating a fuel injector having a coil drive for an internal combustion engine of a motor vehicle, the method comprising:

determining a first time delay defining individual time required for signal conditioning of a first measured signal caused by characteristics of a first electronic circuit for a first electrical measurement variable, wherein determining the first time delay defining individual time required for signal conditioning of the first measured signal includes determining time required for at least one of amplification of the first measured signal, determining a second time delay defining individual time required for signal conditioning of a second measured signal caused by characteristics of a second electronic circuit for a second electrical measurement variable, applying an electrical excitation to a coil of the coil drive, which results in an opening movement of a valve needle coupled to a magnetic armature of the coil drive, recording a chronological progression of the first electrical measurement variable of the coil in response to the electrical excitation, determining a time when the opening movement ends based on the recorded chronological progression of the first electrical measurement variable, adjusting the determined time of the opening movement ending based upon time individually required for signal conditioning of the first measured signal as defined by the first time delay, modifying the electrical excitation of the coil such that the valve needle executes a closing movement, recording a chronological progression of the second electrical measurement variable of the coil, and determining a time when the closing movement ends based on the recorded chronological progression of the second electrical measurement variable in response to the modified electrical excitation, adjusting the determined time of the closing movement ending based upon time individually required for signal conditioning of the second measured signal as defined by the second time delay, wherein one of the two measurement variables represents a level of the voltage applied to the coil and the other of the two measurement variables represents a strength of a current that flows through the coil, and adapting an electrical activation of the fuel injector based on the time when the opening movement ends and the time when the closing movement ends time, such that a predetermined quantity of fuel is injected using an injection operation.

11. A device for determining the movement behavior over time of a fuel injector having a coil drive for an internal combustion engine of a motor vehicle, the device comprising:

an electrical regulating unit configured to apply an electrical excitation to a coil of the coil drive, which results in an opening movement of a valve needle coupled to a magnetic armature of the coil drive, a measuring unit configured to record a chronological progression of a first electrical measurement variable of the coil in response to the electrical excitation, and a data processing unit configured to:

determine a first time delay defining individual time required for signal conditioning of a first measured signal caused by characteristics of a first electronic circuit for a first electrical measurement variable, wherein determining the first time delay defining individual time required for signal conditioning of the first measured signal includes determining time required for at least one of amplification of the first measured signal, determine a second time delay defining individual time required for signal conditioning of a second measured signal caused by characteristics of a second electronic circuit for a second electrical measurement variable by the second electronic circuit, and determine a time when the opening movement ends based on the recorded chronological progression of the first electrical measurement variable, adjust the determined time of the opening movement ending based upon time individually required for signal conditioning of the first measured signal as defined by the first time delay, wherein the electrical regulating unit is further configured to modify the electrical excitation of the coil such that the valve needle executes a closing movement, wherein the measuring unit is further configured to record a chronological progression of the second electrical measurement variable of the coil, wherein the data processing unit is further configured to determine a time when the closing movement ends based on the recorded chronological progression of the second electrical measurement variable in response to the modified electrical excitation, and adjust the determined time of the closing movement ending based upon time individually required for signal conditioning of the second measured signal as defined by the second time delay, wherein one of the two measurement variables represents a level of the voltage applied to the coil, and the other of the two measurement variables represents a strength of a current which flows through the coil.

12. The device of claim 11, wherein the first electrical measurement variable represents the strength of the current that flows through the coil, and the second electrical measurement variable represents the level of the voltage applied to the coil.

13. The device of claim 11, wherein the first electronic circuit is different from the second electronic circuit.

14. The device of claim 11, wherein the device is configured to provide at least one of the following:

(a) the determination of the first time delay includes:

feeding a first test signal into the first electronic circuit, wherein the first test signal has at least an approximate step-shaped change in input, and evaluating a chronological progression of a first output signal of the first electronic circuit, wherein the first output signal is a response of the first electronic circuit to the first test signal, and (b) the determination of the second time delay includes:

feeding a second test signal into the second electronic circuit, wherein the second test signal has at least an approximate step-shaped change in input, and evaluating a chronological progression of a second output signal of the second electronic circuit, wherein the second output signal is a response of the second electronic circuit to the second test signal.

15. The device of claim 14, wherein the first test signal and/or the second test signal are component of an electrical excitation, which is applied to the coil drive of the fuel injector in real operation of the internal combustion engine.

16. The device of claim 14, wherein the device is configured to provide at least one of the following:

the first test signal has a further approximate step-shaped change in input, which is opposite to the first approximate step-shaped change in input, and the second test signal has a further approximate step-shaped change in input, which is opposite to the second approximate step-shaped change in input.

17. An internal combustion engine of a motor vehicle, comprising:

a fuel injector having a coil drive;

an engine controller comprising a device for determining the movement behavior over time of the fuel injector, the device comprising:

an electrical regulating unit configured to apply an electrical excitation to a coil of the coil drive, which results in an opening movement of a valve needle coupled to a magnetic armature of the coil drive, a measuring unit configured to record a chronological progression of a first electrical measurement variable of the coil in response to the electrical excitation, and a data processing unit configured to:

determine a first time delay defining individual time required for signal conditioning of a first measured signal caused by characteristics of a first electronic circuit for a first electrical measurement variable, wherein determining the first time delay defining individual time required for signal conditioning of the first measured signal includes determining time required for at least one of amplification of the first measured signal, determine a second time delay defining individual time required for signal conditioning of a second measured signal caused by characteristics of a second electronic circuit for a second electrical measurement variable, and determine a time when the opening movement ends based on the recorded chronological progression of the first electrical measurement variable, adjust the determined time of the opening movement ending based upon time individually required for signal conditioning of the first measured signal as defined by the first time delay, wherein the electrical regulating unit is further configured to modify the electrical excitation of the coil such that the valve needle executes a closing movement, wherein the measuring unit is further configured to record a chronological progression of the second electrical measurement variable of the coil, wherein the data processing unit is further configured to determine a time when the closing movement ends based on the recorded chronological progression of the second electrical measurement variable in response to the modified electrical excitation, and adjust the determined time of the closing movement ending based upon time individually required for signal conditioning of the second measured signal as defined by the second time delay, and wherein one of the two measurement variables represents a level of the voltage applied to the coil, and the other of the two measurement variables represents a strength of a current which flows through the coil.

* * * * *